United States Patent [19]

Cork

[11] 4,282,041

[45] Aug. 4, 1981

[54] METHOD FOR REMOVING ALUMINIDE COATINGS FROM NICKEL OR COBALT BASE ALLOYS

[75] Inventor: Frank Cork, Alvaston, England

[73] Assignee: Rolls-Royce Limited, London, England

[21] Appl. No.: 103,557

[22] Filed: Dec. 14, 1979

Related U.S. Application Data

[63] Continuation of Ser. No. 966,757, Dec. 5, 1978, abandoned.

[51] Int. Cl.[3] ..... C23G 1/04

[52] U.S. Cl. ..... 134/3; 134/41; 252/101; 252/146

[58] Field of Search ..... 134/3, 41; 252/101, 252/142, 146, 79.4, 79.2

[56] References Cited

U.S. PATENT DOCUMENTS

| | | | |
|---|---|---|---|
| 2,446,060 | 7/1948 | Pray et al. | 242/101 |
| 3,349,036 | 10/1967 | Campbell | 252/101 |
| 3,367,874 | 2/1968 | Haviland et al. | 252/142 X |
| 3,373,114 | 3/1968 | Grunwald | 134/3 X |
| 3,458,353 | 7/1969 | Baldi | 134/3 |
| 3,607,398 | 9/1971 | Lucas | 134/3 |
| 3,622,391 | 11/1971 | Baldi | 134/3 |
| 3,833,414 | 9/1974 | Grisik et al. | 134/41 X |
| 4,032,359 | 6/1977 | Fisher et al. | 134/3 |

*Primary Examiner*—Marc L. Caroff

*Attorney, Agent, or Firm*—Cushman, Darby & Cushman

[57] ABSTRACT

A method of removing aluminium containing alloy coatings from nickel or cobalt base alloy substrates in which the coated substrate is immersed in an aqueous mixture of nitric and sulphamic acids until coating dissolution is complete. A solution containing 5 to 30% vol./vol. nitric acid and from 5 to 30% wt./vol. sulphamic acid is preferred.

5 Claims, No Drawings

METHOD FOR REMOVING ALUMINIDE COATINGS FROM NICKEL OR COBALT BASE ALLOYS

This is a continuation of application Ser. No. 966,757 filed Dec. 5, 1978, now abandoned.

This invention relates to a method of and mixture for the removal of aluminium-containing alloy coatings from nickel or cobalt base alloy substrates.

In order to enhance their resistance to corrosion, nickel or cobalt base alloys are often provided with a thin coating of an aluminium-containing alloy usually by the technique commonly known as aluminising. If coatings of this type are damaged, it is frequently necessary to remove the whole or a major portion of the coating from the substrate before a fresh coating may be applied. This is essential if the coated substrate is, for example, in the form of an aerofoil blade for a gas turbine propulsion engine. Such blades are manufactured to an extremely high degree of accuracy and consequently any surface discontinuities cannot be tolerated.

Aluminium containing alloy coatings are most commonly removed by chemical dissolution. However, it is difficult to achieve dissolution of the coating without the occurrence of significant intergranular substrate attack. Moreover concentrated acid mixtures frequently employed for coating removal are usually heated at temperatures in the region of 80° C. in order to achieve an acceptable coating removal rate. Such temperatures seriously restrict the use of wax based masking compounds which are necessary if only partial coating removal is desired.

It is an object of the present invention to provide a method of and mixture for the removal of aluminium-containing alloy coatings from nickel or cobalt base alloy substrates whereby minimal substrate attack is achieved.

According to one aspect of the present invention, a method of removing an aluminium containing alloy coating from a nickel or cobalt base alloy substrate comprises immersing the coated substrate in an aqueous mixture of nitric and sulphamic acids until substantially all of the coating has been dissolved and then removing the substrate from the solution.

The aqueous coating removal mixture preferably contains from 5 to 30% vol./vol. nitric acid and from 5 to 30% wt./vol. sulphamic acid.

The temperature of the coating removal mixture is preferably maintained at between room temperature and 60° C.

Said coated substrate may be dry blasted prior to immersion in said coating removal mixture in order to remove surface oxides.

According to a further aspect of the present invention, a mixture for removing an aluminium containing alloy coating from a nickel or cobalt base alloy substrate comprises an aqueous solution of nitric and sulphamic acids.

The following example will serve to illustrate the present invention:

Eight nickel base alloy aerofoil blades were dry blasted in order to remove surface oxidation before being divided up into four groups of two blades. Each blade had been aluminised i.e. each had a coating of nickel aluminide. The nickel aluminide coating varied in depth between 0.8 to 2 thousandths of an inch.

All of the blades were totally immersed in an aqueous solution containing 5% wt./vol. sulphamic acid and 10% vol./vol. nitric acid and maintained at a temperature of 40° C. At four-hourly intervals, one group of blades was removed from the solution dry blasted and examined for intergranular attack by microsectioning. The results obtained were as follows:

| Blade Group | Time in Solution | Depth of Intergranular Attack |
|---|---|---|
| 1 | 4 hours | 0.0003 inches |
| 2 | 8 hours | 0.0005 inches |
| 3 | 12 hours | 0.0009 inches |
| 4 | 16 hours | 0.0011 inches |

Examination also revealed that substantially all of the nickel aluminide coating had been removed after a period of four hours immersion in the solution.

In order to compare the degree of intergranular attack resulting from the method and mixture of the present invention with existing acid coating removal solutions, a further test was carried out.

Eight more aerofoil blades similar to those used in the above example but which had not been aluminised were dry blasted and then immersed in a known coating removal solution containing 1 part by vol. glacial acetic acid, 1 part by vol. 1.42 SG nitric acid and 2 parts by vol. phosphoric acid. The solution was maintained at a temperature of 80° C.

After four hours, four of the blades were removed from the solution dry blasted and examined for intergranular attack. The remaining blades were removed from the solution after a further four hours and similarly dry blasted and examined.

The depth of intergranular attack on the blades was more severe and widespread than was the case with the nitric acid/sulphamic acid solution. Intergranular attack to a depth of 0.0016 inches was observed on the first four blades removed from the solution whilst the remaining blades had intergranular attack to a depth of 0.0035 inches. Thus intergranular attack by the nitric acid/phosphoric acid/acetic acid solution was significantly greater than was the case with the nitric acid/sulphamic acid solution in accordance with the present invention.

Since the nitric acid/sulphamic acid solution of the present invention is effective at low temperatures, it is possible to utilise wax-based masking compounds if it is desired to remove only a portion of a coating. The use of such masking compounds may well be impossible at the high temperatures necessary when using conventional acid coating removal solutions.

Although the present invention has been described with reference to the removal of a nickel aluminide coating from a nickel base alloy substrate, we believe that the nitric acid/sulphamic acid solution of the present invention would also be effective in the removal of other aluminium containing alloys such as platinum aluminide and cobalt aluminide, from both nickel and cobalt base alloy substrates.

I claim:

1. A method of removing an aluminum containing alloy coating from a nickel or cobalt base alloy substrate comprising immersing the coated substrate in an aqueous mixture containing from about 5 to about 30% vol./vol. nitric acid and from about 5 to about 30% wt./vol. sulphamic acid.

2. A method of removing an aluminum containing alloy coating from a nickel or cobalt base allow substrate as claimed in claim 1 wherein said aqueous coating removal mixture contains about 10% vol./vol. nitric acid and about 5% wt./vol. sulphamic acid.

3. A method of removing an aluminum containing alloy coating from a nickel or cobalt base alloy substrate as claimed in claim 1 wherein the temperature of the coating removal mixture is maintained at between room temperature and 60° C.

4. A method of removing an aluminum containing alloy coating from a nickel or cobalt base alloy substrate as claimed in claim 1 wherein said coated substrate is dry blasted prior to immersion in said coating removal mixture in order to remove surface oxides therefrom.

5. A method of removing an aluminum containing alloy coating from a nickel or cobalt base alloy substrate while avoiding any substantial intergranular attack of said substrate, said method comprising (1) immersing the coated substrate in an aqueous mixture containing from about 5 to about 30% vol./vol. nitric acid and from about 5 to about 30% wt./vol. sulphamic acid, said mixture being maintained at between room temperature and 60° C;

(2) continuing said immersion until substantially all of the coating is dissolved from the substrate; and thereafter (3) removing the thus treated substrate from the aqueous mixture.

* * * * *